US005425852A

United States Patent [19]

Joiner

[11] Patent Number: 5,425,852

[45] Date of Patent: Jun. 20, 1995

[54] SYSTEM FOR REDUCING BLISTERING OF A WET PAPER WEB ON A YANKEE DRYER

[75] Inventor: John R. Joiner, Vancouver, Wash.

[73] Assignee: James River Paper Company, Inc., Richmond, Va.

[21] Appl. No.: 172,755

[22] Filed: Dec. 27, 1993

[51] Int. Cl.[6] ..... D21F 5/02; D21F 5/18

[52] U.S. Cl. ..... 162/290; 162/359.1; 34/122; 34/123

[58] Field of Search ..... 162/290, 315, 359.1, 162/206, 207, 111, 116, 117; 34/122, 124, 123, 419, 454

[56] References Cited

U.S. PATENT DOCUMENTS

| | | | |
|---|---|---|---|
| Re. 28,459 | 7/1975 | Cole et al. | 34/6 |
| 1,698,818 | 1/1929 | Lorenz . | |
| 1,830,287 | 11/1931 | Ohlin . | |
| 3,213,858 | 10/1965 | Merritt et al. . | |
| 3,808,700 | 5/1974 | Kraus | 34/124 |
| 4,074,441 | 2/1978 | Helversen et al. | 34/122 |
| 4,413,427 | 11/1983 | Villalobos et al. | 34/46 |
| 4,665,631 | 5/1987 | Villalobos . | |
| 5,385,644 | 1/1995 | Hannus et al. | 162/207 |

*Primary Examiner*—W. Gary Jones
*Assistant Examiner*—Calvin F. Padgett, Jr.
*Attorney, Agent, or Firm*—Thomas R. Lampe

[57] ABSTRACT

Blistering of a wet paper web upon a yankee dryer drum is controlled by directing compressed dry air toward the wet paper web in the space between a pressure roll external of the yankee dryer hood and the entry opening between the dryer hood and the yankee dryer drum. The flow of compressed air is controlled so that air flow can be modified across the full width of the wet paper web.

3 Claims, 2 Drawing Sheets

SYSTEM FOR REDUCING BLISTERING OF A WET PAPER WEB ON A YANKEE DRYER

TECHNICAL FIELD

This invention relates to the art of drying paper webs. More particularly, the invention encompasses an apparatus and a method for reducing blistering of a wet paper web caused by heating of the wet paper web by a yankee dryer drum.

BACKGROUND ART

Yankee dryers have been used for many years to dry wet paper webs during the paper making process. Typically, the wet paper web is delivered to and pressed into engagement with the rotating dryer drum with the outer cylindrical surface of the dryer drum delivering the wet paper web to a dryer hood associated with the dryer drum. The dryer drum is heated internally by steam or the like so that the outer surface thereof is maintained at a high temperature. After entering the dryer hood the wet paper web is also subjected to heat on the outer surface (air side) thereof.

A yankee dryer is typically used to produce tissue creped from the yankee dryer drum after passage through the hood. Tissue on a yankee dryer drum will blister when the surface of the dryer drum transfers heat to the sheet too rapidly. The sheet is ruined and operation is disrupted while the problem is being corrected.

Blistering tends to occur in one spot rather than across the entire web. Yankee dryer coating, felt cleanliness and wear, basis weight and yankee dryer condensate removal all can effect blistering.

The machine operator typically attempts to resolve matters by reducing the yankee dryer drum steam pressure and increasing hood temperature. Air side drying, that is drying induced at the outer web surface, is considerably more expensive than steam side drying, that is drying caused by the heated dryer drum as applied to the inner sheet surface. Thus, the common practice of reducing the yankee steam pressure and increasing hood temperature results is a poor one from the standpoint of economizing. This is aggravated by the fact that the machine operator customarily allows himself a wide safety margin so that the problem does not show up during speed changes or other transient conditions on the machine. On drying limited machines blistering can result in reduced production.

A search of the prior art located the following U.S. Pat. Nos.: 1,698,818, issued Jan. 15, 1929, 1,830,287, issued Nov. 3, 1931, 3,213,858, issued Oct. 26, 1965 and 4,665,631, issued May 19, 1987.

None of the above-identified patents addresses the problem of blistering of a wet paper web on a yankee dryer drum.

U.S. Pat. No. 3,212,858, however, does disclose a drying drum wherein a slurry of tobacco is deposited on the drum and formed into a self-supporting sheet or film. A forced air supply jet is provided for directing a stream of air toward the slurry web on the dryer drum to keep water vapor pressure down and prevent boiling while a dispersion is still in liquid form. The air impinges on the dispersion immediately after forming on the drum surface to accelerate the drying rate. The patent provides a general suggestion to the effect that the method can be used for the preparation of sheet material from dispersions or slurries other than tobacco.

The forced air jet of U.S. Pat. No. 3,213,858 is not disclosed with particularity; however, it appears that the jet uniformly and continuously directs compressed air along the full length of the dryer drum, that is along the full width of the slurry film. There is no teaching of employing a plurality of air jets which are independently controlled to direct air to selected different incremental width portions of the slurry. Also, the air stream in the patent is for the purpose of cooling the dispersion at the point of contact between the roll applying the dispersion to the drum and the drum. This will not solve the problem of blistering in the zone between the applicator roll and the exhaust hood shown in the patent.

U.S. Pat. No. 1,830,287 discloses a drum for heating paper wherein a mantle is provided over a portion of the drum and air is supplied thereto to assist in the drying of the paper. The air may be pre-heated to about the same temperature as the air leaving the chamber. The device supplies air to the drum by utilizing a manifold. There is no teaching that the apparatus can be utilized for blister control or prevention.

U.S. Pat. No. 1,698,818 is directed to a device for moistening paper by use of steam. A steam box or chest 26 is associated with a source of steam whereby the steam is supplied to an area adjacent to the cylinder of the apparatus for moistening the paper as the paper is conveyed therealong. Again, this approach is not useful for control of blistering on a yankee dryer drum.

U.S. Pat. No. 4,665,631 is directed to a high speed paper machine dryer. Air nozzles are provided adjacent to dryer rolls in order to provide an sealing nozzle at the locations where pressure build-up problems exist. This arrangement is quite different than that disclosed herein and is inapplicable insofar as providing a solution to blistering is concerned.

DISCLOSURE OF INVENTION

The present invention is based upon my discovery that boiling of a wet paper sheet on a yankee dryer drum is most likely to occur in the short area between the pressure roll nip and the active drying area of the wet end hood of the yankee dryer. In this area or zone conductive heat transfer is at a maximum but mass transfer was found to be negligible due to stagnant saturated air. This is an unexpected result. I have found that an air shower permitting even a small amount of mass transfer will lower the sheet temperature away from the boiling point.

The apparatus of the present invention is relatively simple and inexpensive in construction. Furthermore, it can be utilized to focus in on or be directed to the specific width portion of the wet paper sheet wherein blistering has been found to occur. As indicated above, blistering tends to occur in one or more isolated spots of the web rather than across the entire web.

The structural combination of the present invention includes a yankee dryer including a rotatable heated dryer drum having an outer cylindrical surface and a dryer hood partially encompassing the dryer drum and having a hood interior and a hood wet end defining an opening with the dryer drum outer cylindrical surface communicating with the hood interior.

A pressure roll is provided forming a nip with the dryer drum for pressing a wet paper web against the dryer drum outer cylindrical surface at a nip location exterior of the dryer hood and spaced from the opening. The dryer drum delivers the wet paper web in the machine direction into the hood interior through the opening upon rotation of the dryer drum.

Air applicator means extends along the length of the dryer drum in the cross-machine direction and defines at least one air outlet for directing a flow of dry air toward the wet paper web between the nip location and the opening prior to delivery of the wet paper web into the hood interior by the dryer drum to promote movement of moist air away from the wet paper web and reduce blistering of the wet paper web caused by heating of the wet paper web by the dryer drum.

The air applicator means includes a plurality of air nozzle segments disposed side-by-side along the length of the dryer drum in the cross-machine direction. The air nozzle segments are for directing incremental air flow portions toward different incremental width portions of the wet paper web.

The invention also encompasses a method of reducing blistering of a wet paper web at a yankee dryer including a rotatable dryer drum having an outer cylindrical surface and a dryer hood partially encompassing the dryer drum and having a hood interior and a hood wet end defining an opening with the dryer drum outer cylindrical surface communicating with the hood interior. The wet paper web is pressed by a pressure roll against the dryer drum outer cylindrical surface at a nip location exterior of the dryer hood and spaced from the opening. The dryer drum delivers the wet paper web in the machine direction into the hood interior through the opening upon rotation of the dryer drum.

The method includes the steps of positioning a plurality of air nozzles between the pressure roll and the opening in substantial alignment in a cross-machine direction adjacent to the dryer drum and extending along the length of the dryer drum.

The paper web is observed along the width of the paper web to detect the formation of blisters in the paper web caused by heating of the wet paper web by the dryer drum as the wet paper web is delivered by the dryer drum between the pressure roll and the opening.

Compressed dry air is selectively passed through the air nozzles to direct flow of compressed dry air to incremental width portions of the wet paper web between the pressure roll and the opening wherein blistering is detected to impinge upon the web, cause air turbulence at those incremental web portions to promote evaporation, and cool the web to reduce blistering of the wet paper web caused by heating of the wet paper web by the dryer drum.

Other features, advantages, and objects of the present invention will become apparent with reference to the following description and accompanying drawings.

BEST MODE FOR CARRYING OUT THE INVENTION

Figure 1:
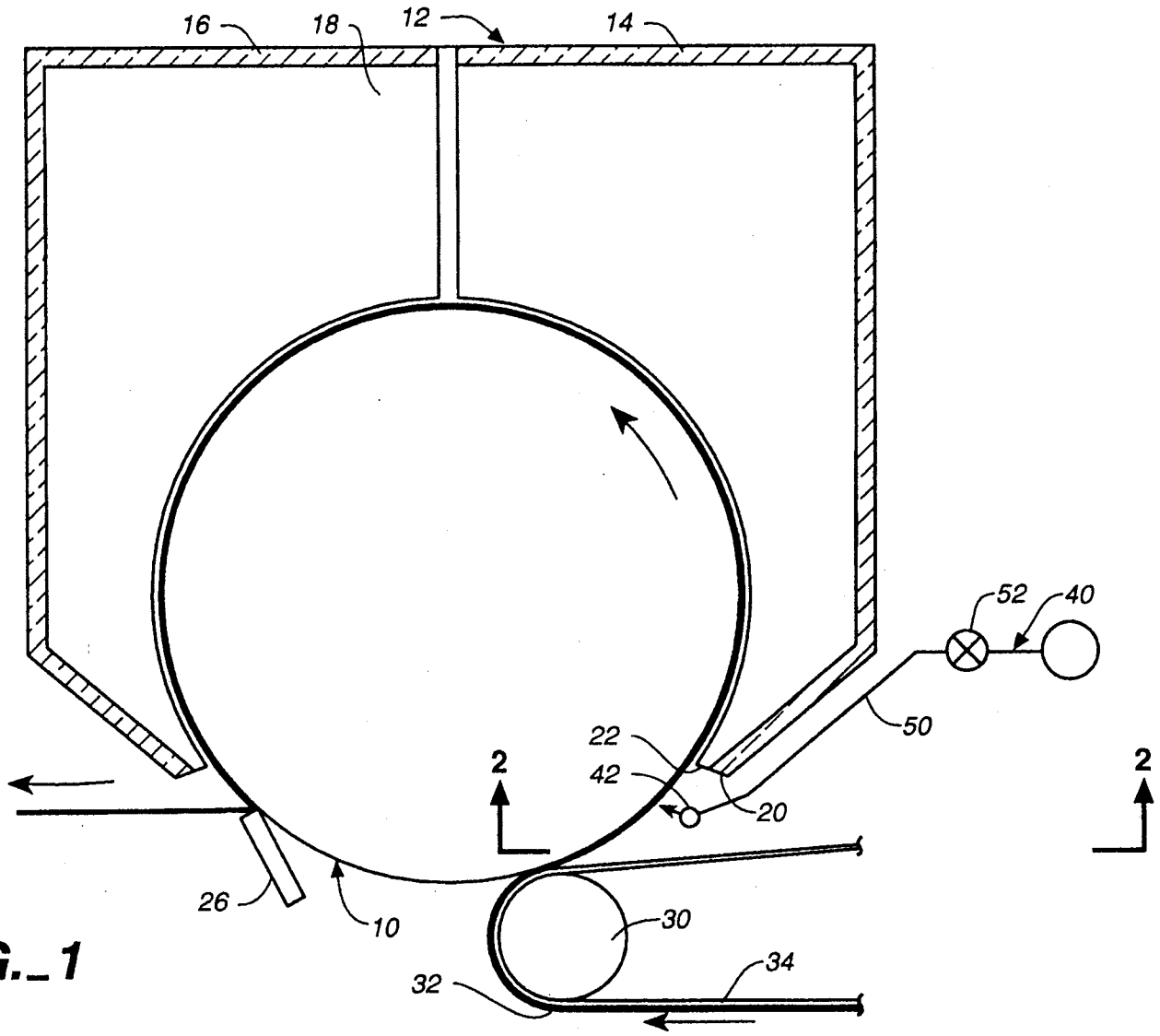
FIG. 1 is a schematic side view of a yankee dryer, a pressure roll and air applicator means constructed in accordance with the teachings of the present invention.
Figure 2:
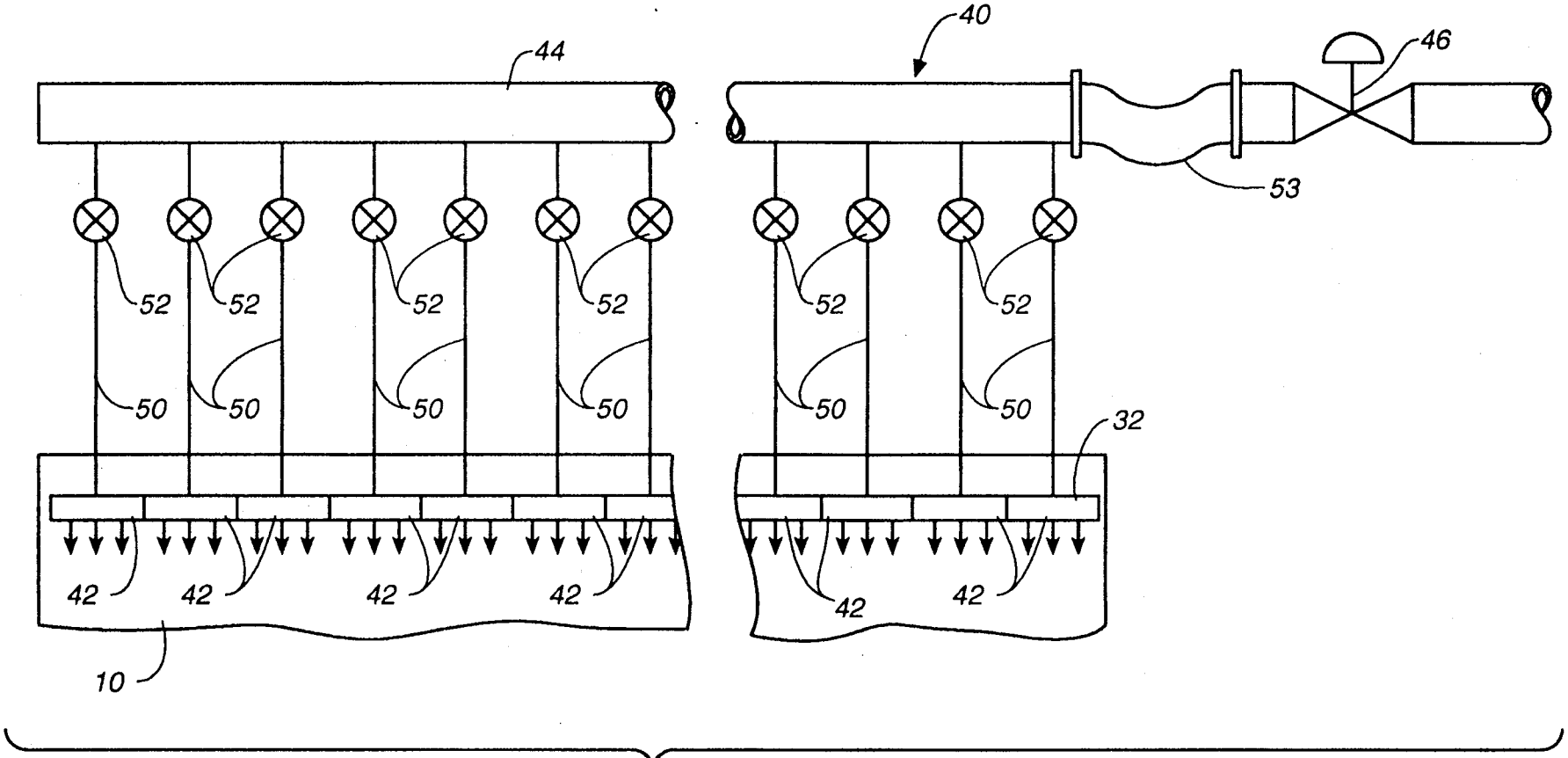
FIG. 2 is a schematic, sectional, partial view of the structural combination of the present invention as taken along the line 2—2 in FIG. 1.

Referring now to the drawings, a yankee dryer includes a heated dryer drum 10 having an outer cylindrical surface and a dryer hood 12 including a wet end hood segment 14 and a dry end hood segment 16.

The dryer hood 12 partially encompasses the dryer drum as is conventional and has a hood interior 18. The hood wet end 20 defines an opening 22 with the dryer drum outer cylindrical surface which communicates with the hood interior.

A pressure roll 30 forms a nip with the dryer drum for pressing a wet paper web 32 against the dryer drum outer cylindrical surface at a nip location exterior of the dryer hood and spaced from the opening 22. The wet paper web 32 is transported to the nip location by a moving felt 34. Rotation of the dryer drum in the direction of the arrow shown in FIG. 1 delivers the wet paper web in the machine direction into the hood interior through opening 22.

The above-described structure is of a conventional nature and configuration. Also conventional is the fact that the interior of the hood is heated by suitable means and the fact that the drum itself is heated, for example by steam being introduced into the interior thereof. For purposes of simplicity and due to the fact that such heating schemes are well known in the art they have not been illustrated. A creping blade 26 removes the sheet from the drum.

Blistering of a wet web on a yankee dryer drum essentially occurs in the space or area between the hood wet end 20 and the nip location as defined by pressure roll 30 and yankee dryer drum 10. Blistering will not occur in the hood due to the fact that high velocity heated air in the hood interior impinges on the web during drying. Also as stated previously, the blistering normally does not occur in a uniform manner across the width of the wet paper web but rather in zones, spots, or increments of the width.

To address and solve the problem the present invention calls for the placement of air applicator means extending along the length of the dryer drum 10 in the cross-machine direction for directing a flow of dry air toward the wet paper web 32 between the pressure roll nip location and opening 32 of the dryer hood prior to delivery of the wet paper web into the hood interior by the dryer drum. The dry air impinges on the web, causes air turbulence at the web to promote evaporation, and cools the web to reduce blistering of the wet paper web caused by heating of the wet paper web by the dryer drum.

The air applicator means is illustrated in diagrammatic fashion and is designated by reference numeral 40. The air applicator means includes a plurality of air nozzle segments 42 disposed side-by-side along the length of the dryer drum in the cross-machine direction. As indicated by the arrows, the air nozzle segments 42 are for the purpose of directing incremental air flow portions toward different incremental width portions of the wet paper web 32. The precise nature of the air nozzle segments is a matter of choice. For example, the actual nozzle exits may be in the form of slits or apertures. In the arrangement shown, the air nozzle segments have a bar-like configuration. However, each air nozzle segment, if desired, may be a separate individual nozzle with a single nozzle opening.

Control means is provided for independently controlling the flow of air out of each of the plurality of air nozzle segments whereby air directed to incremental width portions of the wet paper web can be selectively varied. It is to be understood that the paper web is observed to determine if and where blistering is occurring. If blistering is not a problem air flow can be cut off to all of the nozzle segments. If, however, blistering is detected, the appropriate nozzle segments corresponding to that particular width portion of the paper web will be exposed to compressed air and air directed toward the wet paper web at the trouble spot or zone to solve the problem.

The disclosed air applicator means includes a manifold 44 having an interior which is selectively brought into communication with a suitable source of pressurized air (not shown), a pressure regulating valve 46 being utilized to control such communication.

A plurality of distributor pipes 50 extend from the manifold 44 to the air nozzle segments 42. The means for controlling flow from the manifold to the air nozzle segments may simply comprise a manually or remotely actuatable valve 52 in operable association with each distributor pipe.

Hoods are conventionally retractable so that they can be moved relative to the dryer drum. Preferably, the air applicator means is affixed to the hood whereby retraction of the hood will cause corresponding movement of the air applicator means. A flexible hose segment 53 may be incorporated in the air supply line to facilitate retraction.

The method of the present invention includes the step of positioning a plurality of air nozzles between the pressure roll and the opening 22 in substantial alignment in the cross-machine direction adjacent to the dryer drum 10 and extending along the length of the dryer drum.

The paper web is observed along the width of the paper web to detect the formation of blisters in the paper web caused by heating of the wet paper web by the dryer drum as the wet paper web is delivered by the dryer drum between the pressure roll and the opening.

Compressed dry air is selectively passed through the air nozzles to direct air flow of compressed air to incremental width portions of the wet paper web between the pressure roll and the opening wherein blistering is detected. The dry air impinges on the web, causes air turbulence at the web to promote evaporation and cools the web to reduce blistering of the wet paper web caused by heating of the wet paper web by the dryer drum.

I claim:

1. Apparatus comprising, in combination:

a yankee dryer including a rotatable heated dryer drum having an outer cylindrical surface and a dryer hood partially encompassing said dryer drum and having a hood interior and a hood wet end defining an opening with said dryer drum outer cylindrical surface communicating with said hood interior;

a pressure roll forming a nip with said dryer drum for pressing a wet paper web against said dryer drum outer cylindrical surface at a nip location exterior of said dryer hood and spaced from said opening, said dryer drum delivering said wet paper web in the machine direction into said hood interior through said opening upon rotation of said dryer drum; and air applicator means extending along the length of said dryer drum in the cross-machine direction for directing dry air toward said wet paper web between said nip location and said opening prior to delivery of said wet paper web into said hood interior by said dryer drum to impinge said dry air on said wet paper web between said pressure roll and said opening, cause air turbulence at said wet paper web to promote evaporation, and cool said wet paper web to reduce blistering of said wet paper web caused by heating of said wet paper web by said dryer drum, said air applicator means including a plurality of air nozzle segments disposed side-by-side between said pressure roll and said opening along the length of said dryer drum in the cross-machine direction, each air nozzle segment extending only part way along the length of said dryer drum in the cross-machine direction whereby each air nozzle segment directs an incremental dry air flow portion toward a different incremental width portion of said wet paper web than the other of said air nozzle segments, said air applicator means additionally including control means for independently controlling the flow of dry air out of each of said plurality of air nozzle segments whereby the amount of dry air directed to incremental width portions of said wet paper web between said nip location and said opening by said air nozzle segments can be selectively independently varied.

2. The apparatus according to claim 1 wherein said air applicator means includes a manifold operably associated with said plurality of air nozzle segments to deliver compressed dry air to said plurality of air nozzle segments, said control means comprising valve means for separately controlling compressed dry air flow from said manifold to said plurality of air nozzle segments.

3. The apparatus according to claim 2 wherein said air applicator means additionally comprises a plurality of distributor pipes leading from said manifold, each of said plurality of distributor pipes connecting said manifold to a single air nozzle segment, said valve means comprising a valve operatively associated with each of said distributor pipes to control compressed dry air flow therethrough.

* * * * *